US006141841A

United States Patent [19]

Workman

[11] Patent Number: 6,141,841

[45] Date of Patent: Nov. 7, 2000

[54] ADD-A-BAG ASSEMBLY FOR LUGGAGE

[75] Inventor: David E. Workman, Princeton, N.J.

[73] Assignee: Tumi, Inc., South Plainfield, N.J.

[21] Appl. No.: 09/033,875

[22] Filed: Mar. 3, 1998

[51] Int. Cl.[7] ..... A44B 21/00

[52] U.S. Cl. ..... 24/701; 24/684; 24/265 BC; 190/102

[58] Field of Search ..... 190/102, 108; 24/170, 169, 193, 197, 191, 198, 199, 200, 163 R, 684, 686, 265 BC

[56] References Cited

U.S. PATENT DOCUMENTS

| | | | |
|---|---|---|---|
| 4,621,404 | 11/1986 | Browning . | |
| 4,759,431 | 7/1988 | King et al. . | |
| 4,995,487 | 2/1991 | Plath . | |
| 5,240,106 | 8/1993 | Plath . | |
| 5,311,972 | 5/1994 | Plath . | |
| 5,323,886 | 6/1994 | Chen . | |
| 5,351,793 | 10/1994 | Gibbs . | |
| 5,501,308 | 3/1996 | King . | |
| 5,547,052 | 8/1996 | Latshaw . | |
| 5,560,458 | 10/1996 | Franklin et al. . | |
| 5,593,009 | 1/1997 | King . | |
| 5,829,559 | 11/1998 | Nordstrom et al. | 190/102 |
| 5,890,571 | 4/1999 | Sadow | 190/102 |

OTHER PUBLICATIONS

Brochure for Travelsystem™ snap clip system, dated Jul. 1997.

*Primary Examiner*—James R. Brittain
*Attorney, Agent, or Firm*—Baker & Botts L.L.P.

[57] ABSTRACT

An add-a-bag assembly for luggage has a base attached to a top wall of the luggage and a buckle that is detachably received on the base. The base has a buckle-receiving portion defined by spaced-apart side walls, each of which has a front overhanging abutment surface that slopes downwardly and rearwardly from a front upper surface. A retainer boss projects laterally from each side wall of the buckle and engages one of the overhanging abutment surfaces of the side wall. Releasable rear locking surfaces on the base and the buckle located rearwardly of the bosses and overhanging abutment surfaces engage each other so as to prevent translatory forward movement of the buckle relative to the base and maintain the bosses on the buckle in engagement under the overhanging abutment surfaces of the base. Tab and slot detents latch the buckle in place. A strap is secured to the rear edge of the body portion of the buckle and is adapted to be joined to an article that is piggybacked on the luggage.

22 Claims, 4 Drawing Sheets

ADD-A-BAG ASSEMBLY FOR LUGGAGE

TECHNICAL FIELD OF THE INVENTION

The present invention relates generally to wheeled luggage and, more particularly, to a base and a detachable buckle by which articles can be "piggybacked" on an item of wheeled luggage, an arrangement that is often called an "add-a-bag" feature.

BACKGROUND OF THE INVENTION

Within about the past five years, wheeled luggage of the type having a box-like body, a pair of wheels, one adjacent each end of the bottom edge of the back wall of the body, and a towing handle that pulls out from adjacent the top edge of the back wall have become immensely popular. Most wheeled luggage of that type has a so-called "add-a-bag" device that enables a user to attach other articles to the luggage, such as a briefcase or a carry-on case or bag. Most add-a-bag arrangements have a strap that is attached to the top wall of the wheeled luggage at one end and has a hook at the other end that when in use hangs partway down the front wall of the bag body. When the luggage is being towed, the article attached to the hook of the add-a-bag strap rests on the then-inclined, upwardly facing front wall of the wheeled luggage with its center of gravity generally over the wheels.

The add-a-bag strap and hook accessory of wheeled luggage must be detachable from the wheeled luggage to avoid causing problems in the baggage-handling operations in airports and, more generally, in any venue in which wheeled luggage is handled and packed with other luggage and the strap and hook can catch on equipment and other articles.

A common way of making the add-a-bag strap and hook detachable has heretofore been by a stock quick-release buckle of the type having a tongue with resilient latch fingers that hook into a socket and are squeezed together to release the fingers. Although connecting and releasing quick-release buckles is generally fairly simple, some dexterity and attention to aiming the tongue into the socket correctly is necessary. Also quick release buckles, which are usually made of plastic, are not very durable and are quite prone to being broken, particularly in airport baggage-handling operations, which are well-known for according luggage somewhat less than tender loving care.

Another previously known type of detachable connection for an add-a-bag strap consists of a headed stud fastened to the top of the bag body and a fitting on the strap that has a keyhole slot for the stud. Installing and removing the plate require two movements of the fitting. Removing the plate is particularly tedious, because the edges of the larger hole of the keyhole slot can catch under the head of the stud, and the user has to maneuver the plate radially of the stud to get the larger hole of the slot to register with the head of the stud so that the fitting can be lifted axially off the stud. When the strap is removed from the stud, the stud becomes a relatively sharp projection from the top wall of the body of the luggage that can damage other baggage.

SUMMARY OF THE INVENTION

One object of the present invention is to provide an add-a bag assembly for wheeled luggage that it extremely simple to use and very reliable in use. Another object is to provide an add-a-bag assembly that is virtually indestructible. It is also an object to provide an add-a-bag assembly that is relatively inexpensive to make and install. Yet another object is to provide an add-a-bag assembly that is highly attractive in appearance.

The foregoing objects are attained, in accordance with the present invention, by an add-a-bag assembly for luggage that includes a base that is adapted to be attached to a top wall of the luggage and a buckle that is detachably received on the base. The base has a buckle-receiving portion defined by spaced-apart side walls, each of which has an upper surface that is substantially parallel to the top wall of the luggage and has a front overhanging abutment surface that slopes downwardly and rearwardly from the front of the upper surface of the side wall. The buckle is received between the side walls of the base and has side walls that are located closely adjacent the side walls of the base. A retainer boss projects laterally from each side wall of the buckle and engages one of the overhanging abutment surfaces of the side wall of the base. Releasable rear locking surfaces on the base and the buckle located rearwardly of the overhanging abutment surfaces engage each other so as to prevent translatory forward movement of the buckle relative to the base and to maintain the bosses on the buckle in engagement under the overhanging abutment surfaces of the base. A member, preferably a strap, is secured to the rear edge of the body portion of the buckle and is adapted to be joined to an article.

When in place on the base, the buckle is retained against rearward forces imposed on it by the add-a-bag strap by capture of the bosses on the buckle under the overhanging abutment surfaces of the front ends of the side walls. The rear locking surfaces on the base and the buckle prevent the buckle from translating forwardly relative to the base, thus keeping the bosses on the buckle captured under the abutment surfaces. The bosses can be made strong in shear, and the side walls of the buckle from which the bosses extend transfer pulling forces from the strap to the bosses. The forces imposed by the bosses on the overhanging abutment surfaces are sustained by the side walls of the buckle-receiving portion of the base. Thus, the load from the strap is transmitted along two load transfer paths, each of which is provided by closely adjacent, paired walls, one wall on the buckle and the other on the base. Loads are transferred between the paired walls by a boss that bridges only a small gap and is loaded mainly in shear. The boss can have a cross-sectional area sufficiently large to attain a specified shear strength.

As explained below in greater detail, the buckle is installed on the base by orienting it obliquely to the base, rear end raised above the front end, inserting the bosses under the overhanging abutment surfaces, and pushing the rear end down into place so as to engage the rear locking surfaces on the body and base. Installation and removal of the buckle are both extremely easy to do.

Inasmuch as there are usually no upward forces imposed on the part of an add-a-bag device that is attached to the top wall of wheeled luggage when the add-a-bag device is in use, it is not essential to provide for a downward retaining force in the coupling between the buckle and base—the tension in the strap acts rearwardly parallel to the top of the bag and maintains the bosses engaged with the abutment surfaces and the locking surfaces in engagement. It is, nonetheless, very desirable to provide at least one detent between parts of the base and the buckle spaced apart rearwardly from the bosses on the buckle so as to inhibit upward movement of the rear end of the buckle relative to the front end and possible detachment of the buckle from the base. The detent keeps the buckle latched to the base when the add-a-bag device is not in use, thus keeping it from accidentally falling off. Also, if the user first attaches the buckle to the base and then attaches a bag to the hook (or other element) on the strap, he might well lift the strap up and in the process disconnect the buckle from the base.

On the other hand, another aspect of the present invention is that the buckle can be detached from the base by simply pulling up on the strap or even lifting up the article attached to the strap high enough and with enough force to tension the strap and release the detent(s). The detent(s) readily releases, and the bosses will slide up the sloping overhanging abutment surfaces and be completely released from the base. The user does not have to touch the buckle, which is a real convenience when he or she is struggling with a lot of luggage and wants to remove the article piggybacked on the add-a-bag, such as at an airport baggage security gate.

In preferred embodiments, the base will have a downwardly open, box-like protuberance located between the side walls and having dependent side flanges and a dependent rear flange, and the top wall of the buckle will have dependent side flanges in close clearance from the side flanges of the protuberance so as to impede lateral and skewing movements of the buckle relative to the base. Rib and slot detents may be provided between each dependent side flange of the protuberance and the adjacent dependent side flange of the buckle. The top wall of the buckle may also have a rear dependent flange and spaced-apart ribs that project forwardly from the rear dependent flange and engage a rear surface of the dependent rear flange of the protuberance. The ribs on the buckle and the rear flange of the protuberance are locking surfaces that prevent forward displacement of the buckle relative to the base.

Preferably, the buckle has a top surface that is substantially flush with top surfaces of the base adjacent the buckle-receiving portion. The flush surfaces present a neat appearance and protect the buckle from receiving an impact that might dislodge it.

It is desirable that the bosses have substantially circular cylindrical external surfaces concentric with an axis through the bosses. Inasmuch as the buckle is installed on the base by inserting the bosses under the overhanging abutment surfaces of the base, the circular cylindrical shape facilitates smooth and easy insertion in a wide range of "angles of attack." Another highly preferred feature is the provision on the base of front wall portions located forwardly of the overhanging front abutments and sloping rearwardly and downwardly such as to guide the bosses by a camming action into engagement with the overhanging front abutments.

As mentioned above, the member secured to the rear edge of the body portion of the buckle and adapted to be joined to an article is ordinarily a strap. Preferably, the buckle has a strap-coupling portion joined to the rear edge of the body portion, the strap being attached to the strap-coupling portion. In one suitable arrangement the strap-coupling portion has a slot oriented transversely to the front to rear center axis of the buckle and a cinch bar extending longitudinally across the slot. The strap is cinched through the slot and around the cinch bar. The cinching arrangement permits the length of the strap to be adjusted, which in turn enables the piggybacked article to be located in a favorable position along the front wall of the bag body. The strap-coupling portion may project rearwardly with respect to the rear edge of the base of the assembly.

It is very advantageous to integrate the buckle and base with a handle mount for the luggage. To that end, the base has end portions extending laterally with respect to each side wall of the buckle-receiving portion, each end portion being adapted to receive an end portion of a carrying handle. In addition to minimizing the number of parts and assembly steps, the handle protects the add-a-bag base from impacts. In that regard, however, the base is inherently highly durable and has no protruding parts that could be damaged if struck. Note, also, that the lack of protruding parts prevents the add-a-bag feature from damaging other baggage, the user or other persons.

BRIEF DESCRIPTION OF THE DRAWINGS

For a more complete understanding of the present invention and additional preferred features, and the advantages thereof, reference may be made to the following written description of an exemplary embodiment, taken in conjunction with the accompanying drawings, in which.

DESCRIPTION OF THE EMBODIMENTS

Figure 1:
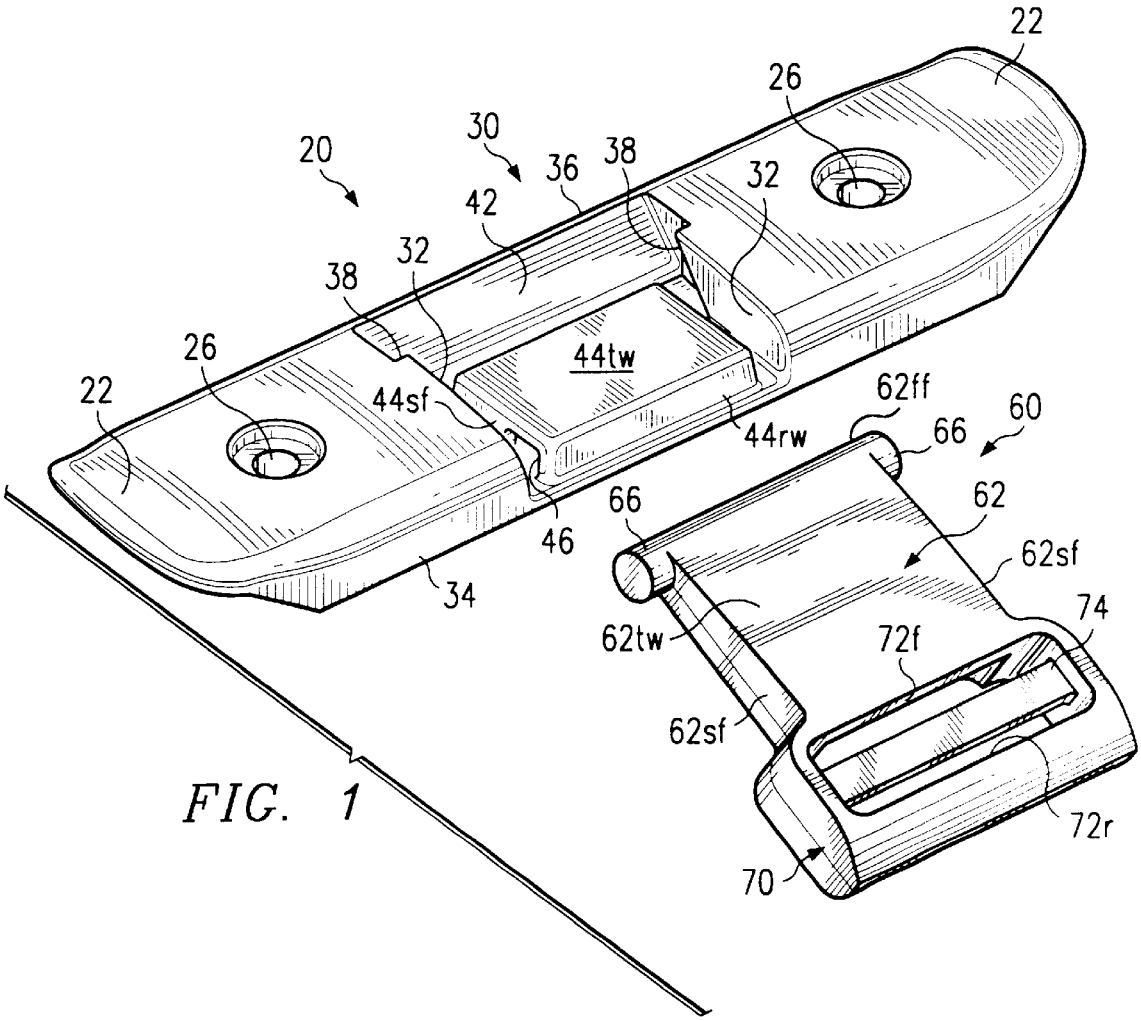
FIG. 1 is an exploded top three-quarter perspective view of the embodiment.
Figure 3:
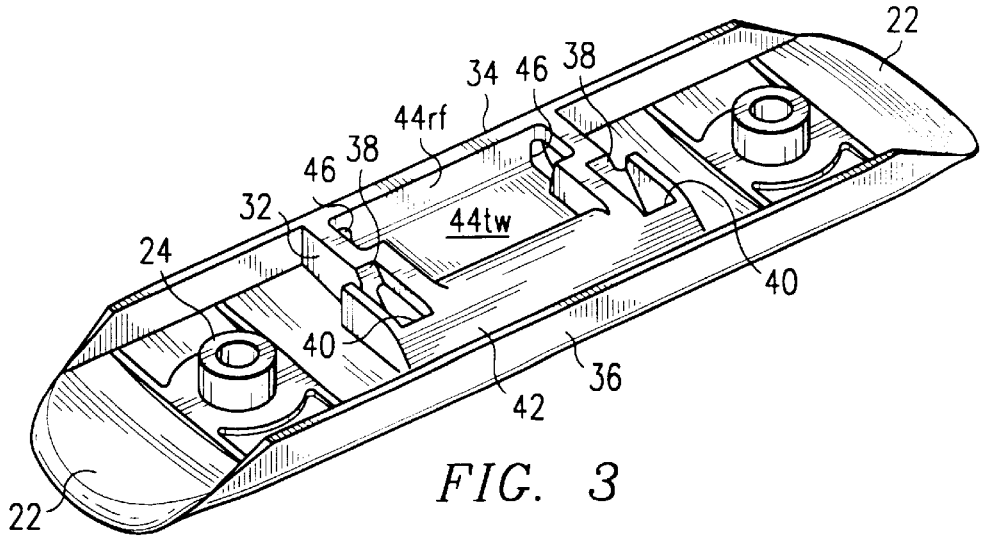
FIG. 3 is a bottom three quarter perspective view of the base.
Figure 2:
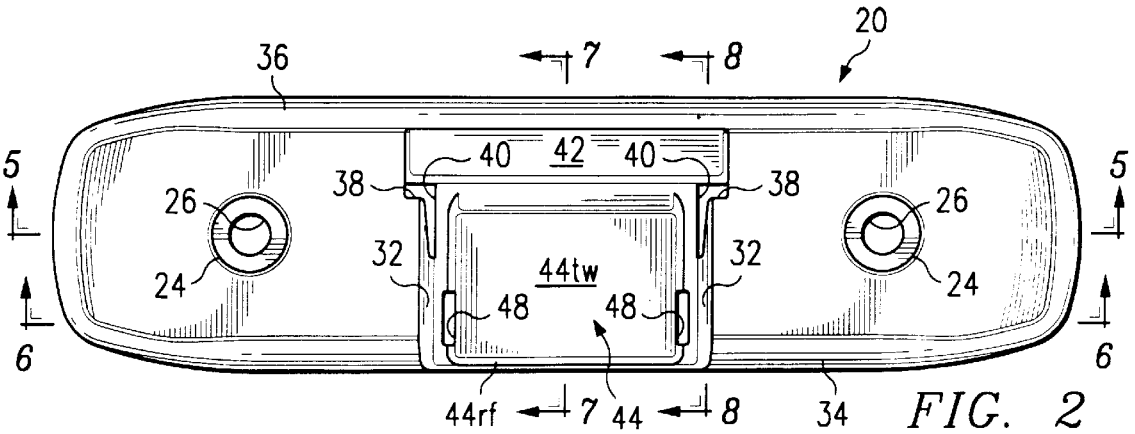
FIG. 2 is a top plan view of the embodiment.
Figure 4:
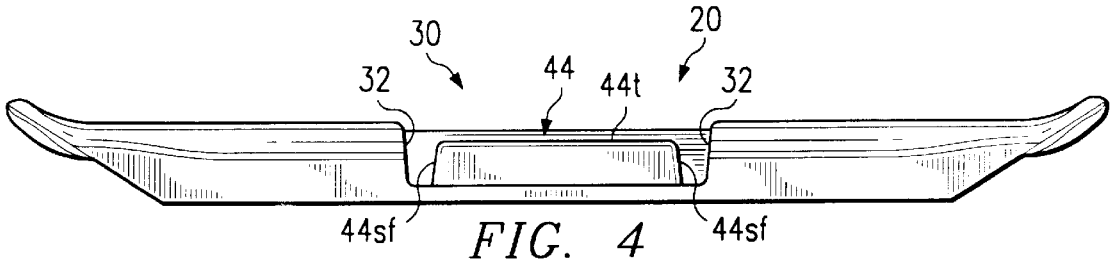
FIG. 4 is a rear elevational view of the base.
Figure 5:
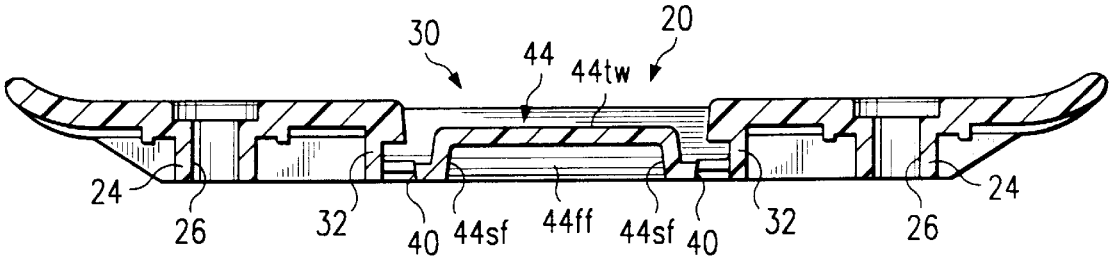
FIG. 5 is a rear cross-sectional view of the base, taken along the lines 5—5 of FIG. 2.
Figure 6:
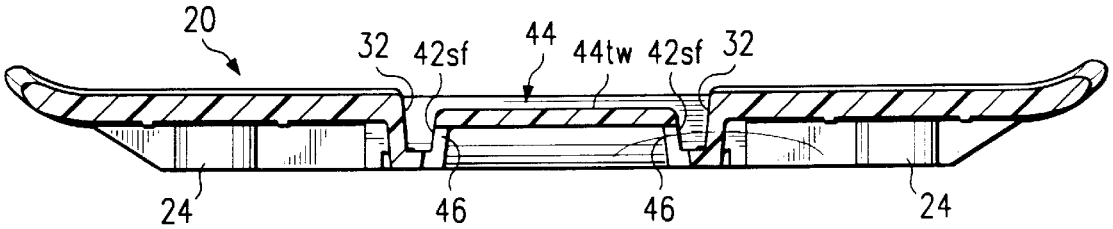
FIG. 6 is a rear cross-sectional view of the base, taken along the lines 6—6 of FIG. 2.
Figure 7:
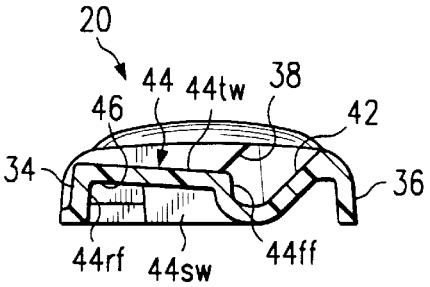
FIG. 7 is a side cross-sectional view of the base, taken along the lines 7—7 of FIG. 2.
Figure 8:
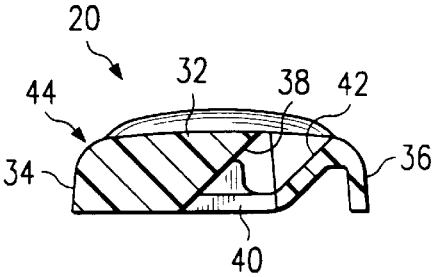
FIG. 8 is a side cross-sectional view of the base, taken along the lines 8—8 of FIG. 2.
Figure 9:
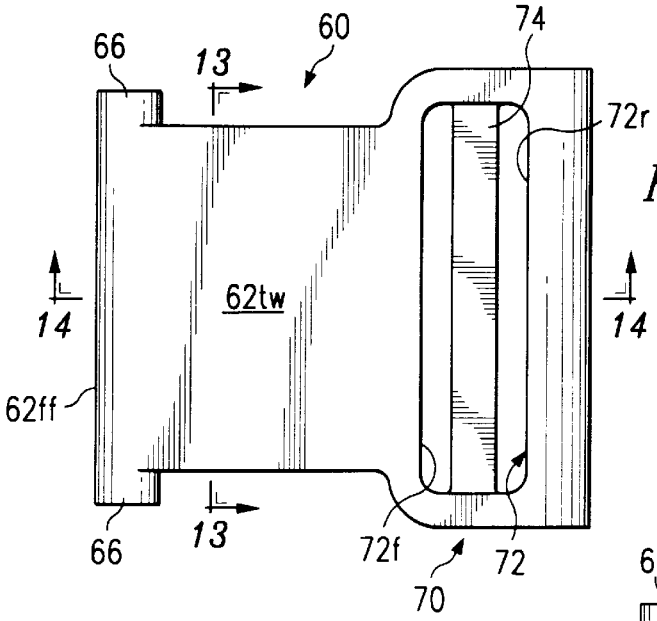
FIG. 9 is a top plan view of the buckle of the embodiment.
Figure 10:
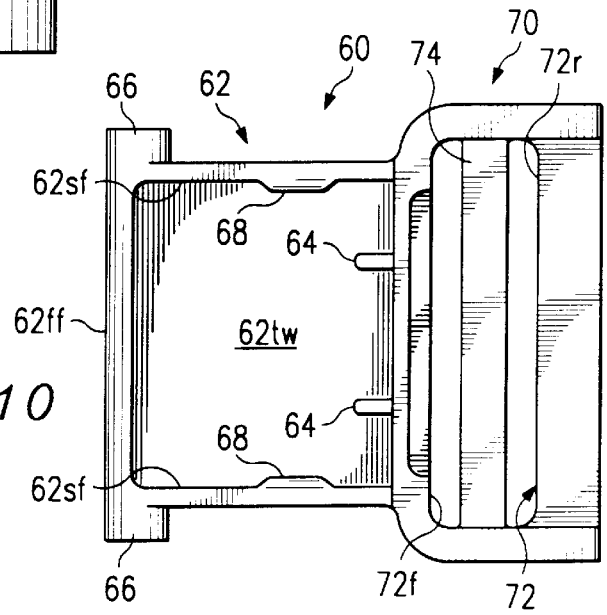
FIG. 10 is a bottom plan view of the buckle of the embodiment.
Figure 11:
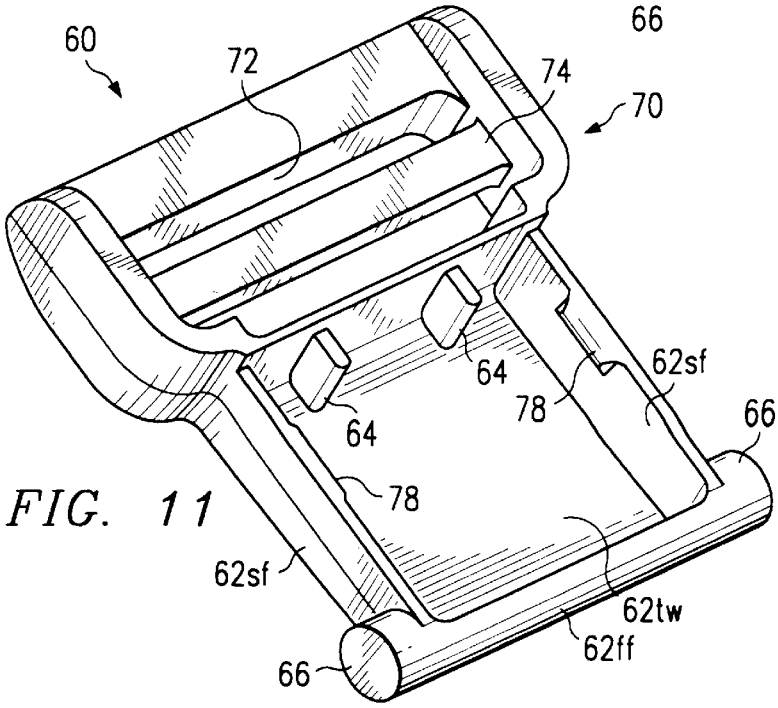
FIG. 11 is a bottom three-quarter perspective view of the buckle.
Figure 12:
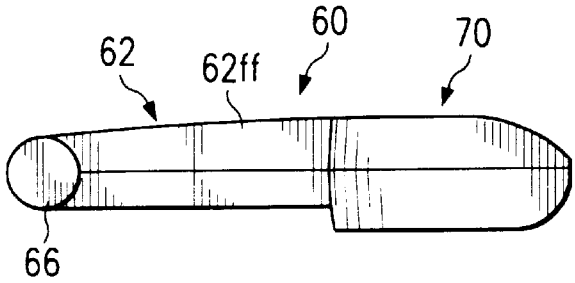
FIG. 12 is a side elevational view of the buckle.
Figure 13:
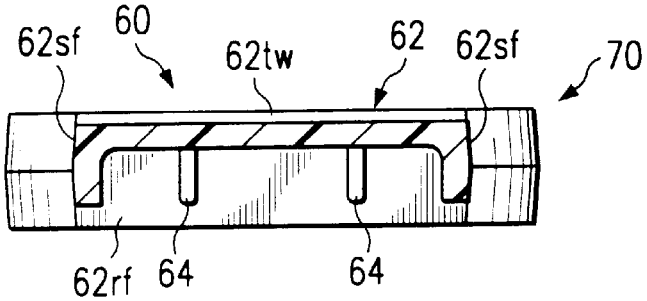
FIG. 13 is a rear cross-sectional view of the buckle, taken along the lines 13—13 of FIG. 9.
Figure 14:
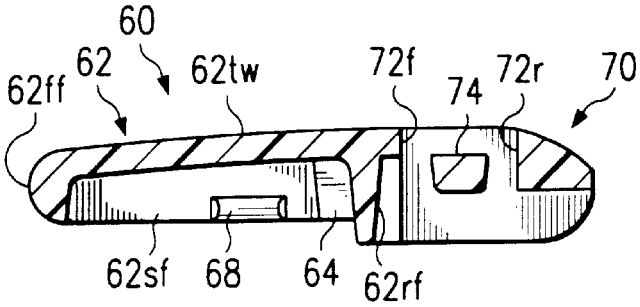
FIG. 14 is a side cross-sectional view of the buckle, taken along the lines 14—14 of FIG. 9.
Figure 15:
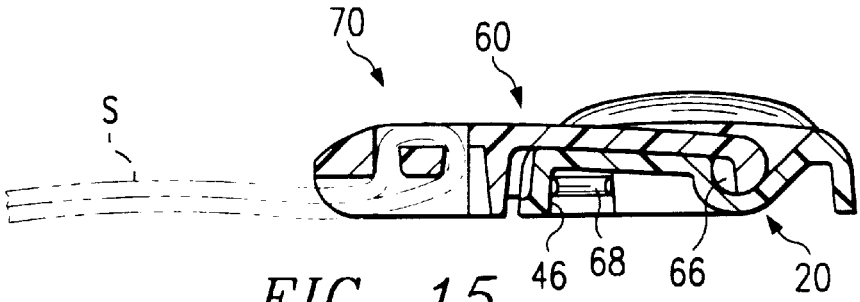
FIG. 15 is a side cross-sectional view showing the buckle attached to the base and the strap installed on the buckle.

An exemplary embodiment of the present invention and its advantages are best understood by referring to FIGS. 1 to 15 of the drawings, like numerals being used for like and corresponding parts shown in the various FIGURES. The teachings of the present specification may be used to advantage in add-a-bag assemblies of various specific configurations.

The embodiment includes a base 20 and a buckle 60, each of which is made by injection-molding in two-part molds of a suitable rigid, durable polymeric material, a process that has influenced some aspects of the specific design of the embodiment. The base 20 is configured to serve as both a mount for the add-a-bag buckle and for a handle (not shown), which can be attached to the base in any suitable manner. A preferred form of handle has a semi-rigid gripping portion and integral, moderately flexible end straps (not shown) that are bent into loops, which turn under the end portions 22 of the base and are secured by reception of holes (not shown) in the end straps over screw bosses 24 on the underside of the base. Reference may be made to U.S. Design patent application Ser. No. 29/084,470 filed Mar. 3, 1998, which shows the handle and base 20 and which is hereby incorporated by reference for all purposes. The base 20 is fastened by screws received through the holes 26 in the bosses 24 to a top pan (not shown) of the wheeled luggage. A base can also be configured to be separate from the carrying handle.

A buckle-receiving portion 30 in the center part of the base 20 releasably receives and retains the buckle 60. Side walls 32 extending from the rear edge 34 partway toward the front edge 36 define the sides of the buckle-receiving portion and terminate in overhanging front abutment surfaces 38 that slope downwardly and rearwardly with respect to the front edge 36. The surfaces 38 are formed by bosses on the bottom mold part, which accounts for the holes 40 immediately below the surfaces 38. A downwardly and rearwardly sloping front wall 42, which is parallel to the surfaces 38, serves as a camming or guide surface for guiding the buckle 60 into place on the base 20. A box-like protuberance 44 having a top wall 44*tw*, side flanges 44*sf* and a rear flange 44*rf* occupies most of the area between the side walls 32. A curved front flange 44*ff* joins the protuberance 44 to the front wall 42. Each side flange 44*sf* of the protuberance has a detent hole 46, the upper edge of which is also the undersurface of the top wall 44*tw*. Each detent hole is, in fact, a missing segment of the side flange 44*sf*, and is formed by a boss on the lower mold and accounts for the holes 48 (see FIG. 2). The walls and flanges described above form a generally U-shaped (in plan) recess in the base 20.

The buckle 60 has a box-like body portion 62, the top wall 62*tw* of which overlies the top wall 44*tw* of the protuberance 44 of the base when the buckle is in place on the base. Dependent side flanges 62*sf* reside in close clearance with the side flanges 44*sf* of the protuberance and keep the buckle 60 from displacing from side to side or skewing relative to the base 20. The front ends of spaced apart ribs 64 engage the rear flange 44*rf* and prevent the buckle from translating forwardly. Retainer bosses 66 having circular cylindrical surfaces extend laterally outwardly from the side flanges 64*sf* at their junctures with a front dependent flange 62*ff*, the front and bottom surfaces of which are arcuate in cross-section and match the shapes of the bosses 66.

A buckle tongue 70 extends from the rear edge of the body of the buckle. An elongated hole 72, which is bridged by a cinch bar 74, receives a loop of a strap S (see FIG. 15), which leads back from the buckle to a suitable hook or other fitting that hangs down over the rear wall of the luggage and receives a piggy-backed article. The strap S passes under the tongue 70, up through the front part 72*f* of the slot, around the bar 74 and back through the rear part 72*r* of the slot behind the bar. The length of the strap can be adjusted. Other ways of attaching a strap to the buckle are possible.

The buckle 60 is installed on the base 20 by tilting it anywhere from, say 20° to 90°, rear end up, and sticking the front flange 62*ff*, 66 into the recess defined between the sloping front wall 42 of the base and the front flange 44*ff* of the protuberance 44. The wall 42 guides the front flange 62*ff* of the buckle down and to the rear and locates the retainer bosses 66 under the overhanging front abutment surfaces 38 at the fronts of the side walls 32. The user then pushes the rear end of the buckle down to seat the body 62 on the protuberance 44. The ribs 64, as mentioned above, keep the bosses 66 in place under the overhanging front abutment surfaces 38 of the base. Tabs 78 on the inner side of each side flange 62*sf* snap into the holes 46—the tabs 78 and holes 46 form tab-slot detents, which latch the buckle to the base. When the buckle is in place on the base, the top wall 62 of the buckle is flush with the top walls of the portions of the base 20 on either side of the buckle-receiving portion 30. The buckle can be detached from the base by simply pulling up the tongue portion 70 or the strap S to release the detents. The retainer bosses 66 slide readily up the overhanging surfaces 38, thus freeing the buckle completely from the base.

What is claimed is:

1. An add-a-bag assembly for luggage comprising a base adapted to be attached to a top wall of the luggage and having a buckle-receiving portion defined by spaced-apart side walls, each of which has an upper surface that is substantially parallel to the top wall of the luggage and has a front overhanging abutment surface that slopes downwardly and rearwardly from a front upper surface of the side wall;

a buckle detachably received between the side walls of the base and having a side wall located closely adjacent each of the side walls of the base and a retainer boss projecting laterally from each side wall of the buckle and engaged with one of the overhanging abutment surfaces of the side wall, the base and buckle having releasable rear locking surfaces located rearwardly of the overhanging abutment surfaces and in engagement with each other so as to prevent translatory forward movement of the buckle relative to the base and maintain the bosses on the buckle in engagement under the overhanging abutment surfaces of the base; and a member secured to the rear edge of the body portion of the buckle and adapted to be joined to an article.

2. An assembly according to claim 1 and further comprising at least one detent interposed between portions of the base and the buckle spaced apart rearwardly from the overhanging abutment surfaces so as to inhibit release of the rear locking surfaces by upward movement of the rear end of the buckle relative to the rear end of the base.

3. An assembly according to claim 1 wherein the buckle has a top wall having an upper surface that is substantially flush with top surfaces of the side walls of the buckle-receiving portion of the base.

4. An assembly according to claim 1 wherein the base has a downwardly open box-like protuberance located between the side walls and having dependent side flanges and a dependent rear flange, and the top surface of the buckle has dependent side flanges in close clearance from the side flanges of the protuberance so as to impede lateral and skewing movements of the buckle relative to the base.

5. An assembly according to claim 4 wherein rib and slot detents are provided between each dependent side flange of the protuberance and the adjacent dependent side flange of the buckle.

6. An assembly according to claim 4 wherein the top wall of the buckle has a rear dependent flange, and spaced-apart ribs project forwardly from the rear dependent flange and engage a rear surface of the dependent rear flange of the protuberance to prevent forward displacement of the buckle relative to the base.

7. An assembly according to claim 1 wherein the bosses have substantially circular cylindrical external surfaces concentric with a transverse axis through the bosses.

8. An assembly according to claim 1 wherein the base has front wall portions located forwardly of the overhanging abutment surfaces and sloping rearwardly and downwardly such as to guide the bosses into engagement with the overhanging abutment surfaces.

9. An assembly according to claim 1 wherein the member secured to the rear edge of the body portion of the buckle and adapted to be joined to an article is a strap, and the buckle has a strap-coupling portion joined to the rear edge of the body portion, the strap being attached to the strap-coupling portion.

10. An assembly according to claim 9 wherein the strap-coupling portion has a transverse elongated slot and a cinch bar extending longitudinally across the slot, and wherein the strap is cinched through the slot and around the cinch bar.

11. An assembly according to claim 9 wherein the strap-coupling portion projects rearwardly from the rear edge of the base of the assembly.

12. An assembly according to claim 1 wherein the base has arm portions extending laterally with respect to each side wall of the buckle-receiving portion, each arm portion being adapted to receive an end portion of a carrying handle of the luggage.

13. An add-a-bag assembly for luggage comprising a base adapted to be attached to a top wall of the luggage and having a top surface, a front edge and a rear edge, a substantially rectangular buckle-receiving recess in the top wall of the base and defined by parallel spaced-apart side walls and a front wall having a surface that slopes downwardly and rearwardly with respect to the top wall and the front edge of the base, each of the side walls having a front surface that is spaced apart from the front wall of the recess, is generally parallel to the surface of the front wall, and defines an overhanging front abutment, and a rear abutment on the base located rearwardly of the front abutments, a buckle detachably received by the buckle-receiving recess in the base and having a body portion having a front end, a rear end, and side walls located adjacent the side walls of the base, a retainer boss projecting laterally from each side wall of the buckle and engaged with one of the overhanging front abutments of the base, and a dependent portion adjacent the rear edge of the body portion and engaging the rear abutment of the base such as to prevent translatory forward movement of the buckle relative to the base and prevent releasing of the bosses on the buckle from engagement under the overhanging front abutments of the base;

at least one detent interposed between portions of the base and the buckle spaced apart rearwardly from the abutments so as to inhibit upward movement of the rear end of the buckle relative to the front end; and a member secured to the rear edge of the body portion of the buckle and adapted to be joined to an article.

14. An assembly according to claim 13 wherein the buckle has a top surface that is substantially flush with top surfaces of the base adjacent the buckle-receiving portion.

15. An assembly according to claim 13 wherein the bosses have substantially circular cylindrical external surfaces concentric with an axis through the bosses.

16. An assembly according to claim 13 wherein the buckle-receiving recess in the base is further defined by a box-like protuberance having side flanges parallel to the side walls, each side flange having a detent slot located rearwardly of the overhanging front abutments, and wherein the body portion of the buckle has dependent side flanges, each having a detent bead received in a detent slot.

17. An assembly according to claim 13 wherein the rear abutment of the base is a rear surface of the protuberance.

18. An assembly according to claim 13 wherein the dependent portion of the buckle is a rib.

19. An assembly according to claim 13 wherein the member secured to the rear edge of the body portion of the buckle and adapted to be joined to an article is a strap, and the buckle has a strap-coupling portion joined to the rear edge of the body portion, the strap being attached to the strap-coupling portion.

20. An assembly according to claim 19 wherein the strap-coupling portion has an elongated transverse slot and a cinch bar extending longitudinally across the slot, and wherein the strap is cinched through the slot and around the cinch bar.

21. An assembly according to claim 19 wherein the strap-coupling portion projects rearwardly from the rear edge of the base of the assembly.

22. An assembly according to claim 13 wherein the base has end portions extending laterally with respect to each side wall of the buckle-receiving portion, each end portion being adapted to receive an end portion of a carrying handle of the luggage.

* * * * *